US008113111B2

(12) United States Patent
Schaltegger et al.

(10) Patent No.: US 8,113,111 B2
(45) Date of Patent: Feb. 14, 2012

(54) DEVICE AND METHOD FOR PREVENTING A TOOL FROM BREAKING DURING FINE BLANKING AND/OR FORMING A WORK PIECE

(75) Inventors: Markus Schaltegger, Berne (CH); Alfio Cristofaro, Reichenburg (CH); Juerg Ochsenbein, Berne (CH)

(73) Assignee: Feintool Intellectual Property AG, Lyss (CH)

( * ) Notice: Subject to any disclaimer, the term of this patent is extended or adjusted under 35 U.S.C. 154(b) by 63 days.

(21) Appl. No.: 12/793,091

(22) Filed: Jun. 3, 2010

(65) Prior Publication Data

US 2010/0319553 A1 Dec. 23, 2010

(30) Foreign Application Priority Data

Jun. 3, 2009 (EP) ..... 09007353

(51) Int. Cl.
*B30B 13/00* (2006.01)
*B30B 15/22* (2006.01)
*B30B 15/28* (2006.01)

(52) U.S. Cl. ..... 100/35; 100/50; 100/347; 100/257; 100/269.19; 83/527

(58) Field of Classification Search ..... 100/35, 100/43, 50, 347, 257, 269.01, 269.14, 269.19, 100/289; 72/21.5, 446, 448; 83/55, 525, 83/526, 527, 530; 74/583, 586
See application file for complete search history.

(56) References Cited

U.S. PATENT DOCUMENTS 5,285,722 A * 2/1994 Schockman ..... 100/347
5,349,902 A * 9/1994 Daniel et al. ..... 100/48
6,267,050 B1 * 7/2001 Brewer ..... 100/257

FOREIGN PATENT DOCUMENTS

DE 6917177 12/1970
DE 24 19 390 C2 11/1975

* cited by examiner

*Primary Examiner* — Jimmy T Nguyen
(74) *Attorney, Agent, or Firm* — Jordan and Hamburg LLP

(57) ABSTRACT

A device and method are provided for preventing a tool from breaking during fine blanking and/or forming in a press. The device includes a fine blanking head positioned above a ram that carries out a stroke movement. The fine blanking head includes, among other things, a main cylinder retaining a V-shaped projection piston, a touch piston, several V-shaped projection pins, a main plate covering the main cylinder and a touch table to which the tool can be connected. Pressure provided by a hydraulic system is introduced to the device in distinct regions. Gaps between certain device components are maintained and monitored for purposes of determining the undesirable presence of foreign objects in the press operating path. If a sensor determines that the gaps are not maintained then the computer which operates valves that supply the pressure from the hydraulic system will shut the press down.

20 Claims, 5 Drawing Sheets

56a 28
19
56
18
33
34
26
19
34
57
P2
P1
P3
17
9
32
25
15
2
20
P2
16
21
24
43
23
35
P3
29
22
30
42
4
31
39
10
HU
38
40
36
5
37
11
6
41
55
MP
7
44
50
12
14
13

DEVICE AND METHOD FOR PREVENTING A TOOL FROM BREAKING DURING FINE BLANKING AND/OR FORMING A WORK PIECE

BACKGROUND OF THE INVENTION

A device for preventing a tool from breaking during fine blanking and/or forming in a press is disclosed. The tool includes an upper and a lower part with a fine blanking head positioned above a ram that carries out a stroke movement. The fine blanking head includes a main cylinder retaining a V-shaped projection piston lying on the stroke axis and several V-shaped projection pins arranged coaxial to the stroke axis, which are axially guided in a main plate covering the main cylinder and supported on a V-shaped projection pressure plate, wherein the main cylinder is held in the head piece of the press and closed by a V-shaped projection cover, and wherein valves connect the fine blanking head with a hydraulic system for producing pressure acting on and influencing the tool parts, which valves are triggered by a computer.

Further disclosed is a method for preventing a tool from breaking during fine blanking and/or forming in a press. The tool includes an upper and a lower part, wherein the main cylinder of the fine blanking head guides a V-shaped projection piston and a touch piston for producing a V-shaped projection force and a stripping force, which forces are pressure generated by a hydraulic system in communication with the fine blanking head, wherein piston pressure is adjusted by valves triggered by a computer.

DE 24 19 390 C2 discloses a device for the protection of a tool set of a hydraulic fine blanking press, the ram of which can be lifted by quick-elevating piston units and a working stroke pressure unit, wherein a detectable gap is present between the ram-driving element and a driven ram part. The detectable gap is maintained when pressure is low and closes when pressure is high. A sensor monitors the pressure conditions and a way switch until the ram has neared the tools to start the regular working stroke. The detectable gap is present between the ram and the frontal surfaces of the piston rods of the quick-elevating pistons and pressure is admitted to the detectable gap by touch cylinders in the ram, when the touch pistons rest against the frontal surfaces.

The detectable gap at the quick-elevating piston is positioned upstream of the ram. This protection device is continuously actuated when the detectable gap closes due to an elevated pressure load. This teaching is believed to not detect punchings, parts or foreign bodies in the tool and thus tool damage cannot be prevented.

DE 69 17 177 U discloses a tool protection apparatus in presses for processing a blank in which a first tool is moved by the working piston and a tool fixed to the frame, in which the press has two switches, which have to be actuated in a predetermined sequence, for interrupting the working stroke in case of an inverse actuating sequence. The first tool is axially movable with regard to the working piston element, which during the working stroke is held at a small distance before the working piston by elastic flexible means. A first limit stop switch, adjustable to the nominal height of the blank to be processed, is actuated by a limit stop, when the piston has moved for a part of its working stroke as predetermined by the adjustment of the first limit stop switch. A further limit stop switch is actuated by a further limit stop, when an element by the blank or a foreign body hitting the second tool is pushed back onto the piston.

The element is a lower tool mounting surface supported on a cylinder, which together with the working piston is enclosed within a ring-shaped pressure chamber, which is connected to a pressure fluid pipe having a shut off element, that makes it possible to let as much compressed air into the ring chamber to hold the mounting surface during the working stroke, in a practically suspended state before the piston.

Disadvantageous with this approach is the necessity of providing a second separate hydraulic system that requires compressed air and thus causes a considerable effort regarding circuitry and construction. Further, after the detection of a foreign body there is no possibility to compensate the kinetic energy of the drive.

Other known solutions for detecting punchings or other foreign bodies in the tool use optical sensors or ultrasonic sensors.

SUMMARY OF THE INVENTION

In one aspect, the present invention is directed to a device that prevents a tool from breaking during fine blanking and/or forming in a relatively simple construction employing relatively fewer parts, thereby reducing costs. The device can absorb high tilting moments and compensate for the kinetic energy of the drive during a return stroke even before the press is switched off.

In one aspect of the present invention, punchings, parts or other foreign bodies are detected by the active elements of the fine blanking head, the head structure including the necessary components to perform that task. A touch piston is provided between a V-shaped projection piston and V-shaped projection pins, that with the V-shaped projection piston on the one hand and with the V-shaped projection pins and the V-shaped projection pressure plate on the other hand are present in an axially movable arrangement relative to each other, wherein the V-shaped projection piston has a first pressure room to which a preloading pressure of the hydraulic system can be admitted. Further, between the V-shaped projection piston and touch piston, there is a second pressure room to which a touch piston pressure can be admitted. Also, the touch piston has a further (third) pressure room to which can be admitted a differential pressure, wherein the first, second, and third pressure rooms, each through a connection in the V-shaped projection cover and by conduits in the main cylinder, are connected with the hydraulic system for admitting pressure to the V-shaped projection piston and the touch piston, with pressure admitted to the touch piston to apply force opposite to the effective direction of the preloading pressure. Further provided, as part of the device, is a touch table held suspendedly against a main plate by fixing means, described later herein, the touch table held at a determined detection distance that is weight compensated by the main plate. The touch table and main plate are positioned below the touch piston, at a head piece position in relative proximity to the ram. A sensor is provided to a gap between the touch table and main plate that in case of a change of the detection distance transmits a signal to the computer to immediately stop the press to protect the upper part of the tool.

The touch table, the main plate, the central support, the main cylinder and the adjusting nut non-positively and/or positively divert the pressing force into the head piece of the press depending on the motion of V-shaped projection piston, V-shaped projection pins and touch piston between upper and lower dead points.

In a specific aspect of the invention, the second pressure room of the V-shaped projection piston is located below a supporting shoulder at the wall of the main cylinder that projects in the direction of the stroke axis towards the lower piston surface of the V-shaped projection piston. Further, the touch piston has a pressure room located below the touch piston shoulder and above a supporting shoulder at the wall of the main cylinder that projects in the direction of the stroke axis. With this design, a touch piston pressure P2 can act on the V-shaped projection piston in the opposite direction to the preloading pressure P1 applied to the V-shaped projection piston, and a differential pressure P3 acts on the touch piston, causing an axial shift of V-shaped projection piston, touch piston and V-shaped projection pins.

Further, the pressure room of the V-shaped projection piston, through a connection in the V-shaped projection cover, is connected to a pressure pipe of the hydraulic system that includes a proportional valve which supplies to the pressure room a preloading pressure for producing a V-shaped projection force or a stripping pressure for producing a stripping force or making the piston motionless.

Also, the second pressure room of the V-shaped projection piston and the pressure room for the touch piston, through a connection at the V-shaped projection cover with a directional control valve, provides pressure to the second pressure room through a feeding pipe in connection with a pressure pipe of the hydraulic system.

In a more specific aspect of the invention, the apparatus is provided with conduits supplying the pressure rooms that are axially aligned in the direction to the stroke axis in the wall of the main cylinder and open by bending into the respective pressure rooms.

Still more specifically, different quantities of hydraulic fluid can be fed into the individual pressure rooms. To realize this, the conduit for the V-shaped projection piston can be provided with a larger diameter than the conduit for the touch piston.

In one particular aspect, a fixing means is provided in the device which comprises a pressure spring and a straining screw and connects the main plate and touch table, which pressure spring and straining screw are positioned in a recess of the main plate, wherein the straining screw penetrates the main plate and the pressure spring provides compensation for the weight of the touch table and the upper part of the tool.

In another particular aspect, the device includes a sensor adjustably positionable in a seat of the main plate, the measuring point of which is determined by a switch flag arranged in the touch table, to provide for adjustment of the detection distance to the gap distance.

The gap distance, in the case of an immediate stop of the press, provides compensation for the kinetic energy, even before the press has stopped.

In another particular aspect, the main plate is attached at a frontal side of the main cylinder facing the ram with screwing means.

In a still further aspect, the touch table of the device is twist-proof and is axially movable with respect to the main plate through guidance provided by guiding pins arranged axially parallel to the stroke axis in holes provided for receiving the guiding pins.

Yet even further, there is an aspect of the invention in which the V-shaped projection pins and the V-shaped projection pressure plate are positioned coaxially with regard to the stroke axis, wherein the pressure plate is fixed at the touch table by a retaining ring and a central support is integrated in the main plate.

In operation, the force of pressure is diverted by means of a non-positive and/or positive connection by hydraulic locking and unlocking of a touch table, a main plate, a central support, a main cylinder and an adjusting nut into the head piece of the press, and by axially shifting the V-shaped projection piston and touch piston in alignment with the stroke axis (HU) prior to delivering the pressure force until the non-positive and/or positive connection between V-shaped projection pressure plate, V-shaped projection pins, touch piston and V-shaped projection piston is reached, wherein, between the touch piston and V-shaped projection pins, a gap distance between the main plate and the touch table is adjusted with hydraulic means and the gap distance weight compensated detection distance between the main plate and the touch table is adjusted with mechanical means, the change of which is scanned by the V-shaped pressure plate and/or the touch table in case of an inverse sequence of the stroke and detected by a sensor transmitting a signal to the computer, which will immediately stop the press.

The kinetic energy is compensated in the gap distance between touch table and V-shaped projection pins because the touch table can move in the direction of the V-shaped projection pins.

In yet another aspect, the present invention is a method for preventing the breaking during fine blanking and forming operations comprising the steps of:

a Preloading a V-shaped projection piston and touch piston to a preloading pressure P1 to realize the non-positive connection between them;

b Applying a differential pressure P3 that differs from the preloading pressure P1 to the touch piston to axially shift the touch piston;

c Maintaining a detection distance TA adjusted to a gap distance between the touch piston and V-shaped projection pins through the touch piston differential pressure P3 and the preloading pressure P1 acting against it for realizing a non-positive connection between the touch piston and V-shaped projection piston, wherein the preloading pressure P1, the touch piston pressure P2 and the differential pressure P3 are adjusted to the condition P1>>P3 and P2=0;

d Superseding the hydraulic fluid under differential pressure P3 in the touch piston pressure room through application of the upper pressure room preloading pressure P1;

e Relieving the pressure on the V-shaped projection piston by switching off the preloading pressure P1 when the upper dead point for the V-shaped projection piston and touch piston is reached;

f Stripping the V-shaped projection piston and touch piston by applying a constant stripping pressure P4 and a constant touch piston pressure P2 to the pressure rooms of V-shaped projection piston and touch piston, with the understanding that pressures P2 and P4 are not necessarily equal;

g Shifting the V-shaped projection piston and the touch piston until a sensor triggers a signal;

h Switching off the stripping pressure P4 for the V-shaped projection piston and the touch piston and applying the preloading pressure P1 to the upper pressure room of the V-shaped projection piston; and i Repeating the step sequence a) to h) in case the sensor has not detected, depending on the ram stroke, a premature change of the detection distance TA.

In a specific aspect of the inventive method, the preloading pressure for the V-shaped projection piston is adjusted to a pressure of more than 110 bar.

In a more specific aspect of the inventive method:

the touch piston pressure P2 and the stripping pressure P4 are adjusted to a low pressure below 110 bar, and the differential pressure P3 is adjusted to a low pressure below 110 bar or to zero.

Further advantages and details of the invention accrue from the following detailed description with reference to the attached drawings.

DETAILED DESCRIPTION OF THE INVENTION

Figure 1:
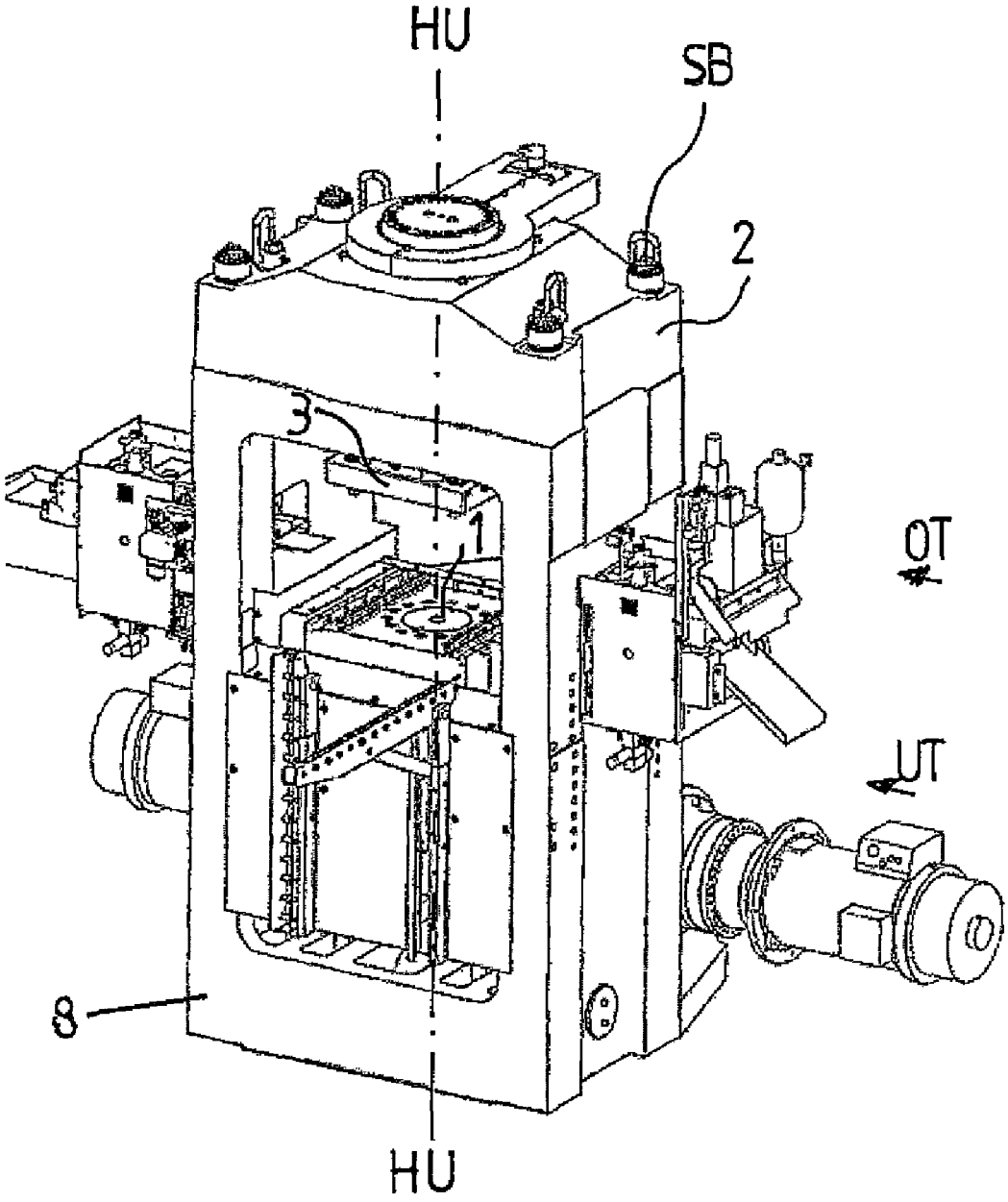
FIG. 1 is a perspective view of the press with the device according to the invention assembled in the head piece.

FIG. 1 shows a perspective view of a mechanically driven, toggle-type fine blanking press. Ram 1, supporting a table top, of this press moves in an upward direction, along the stroke axis HU and towards the head piece 2 of the press. In the head piece 2 of the press, the device according to the invention is positioned in alignment with the stroke axis HU.

Figure 2:
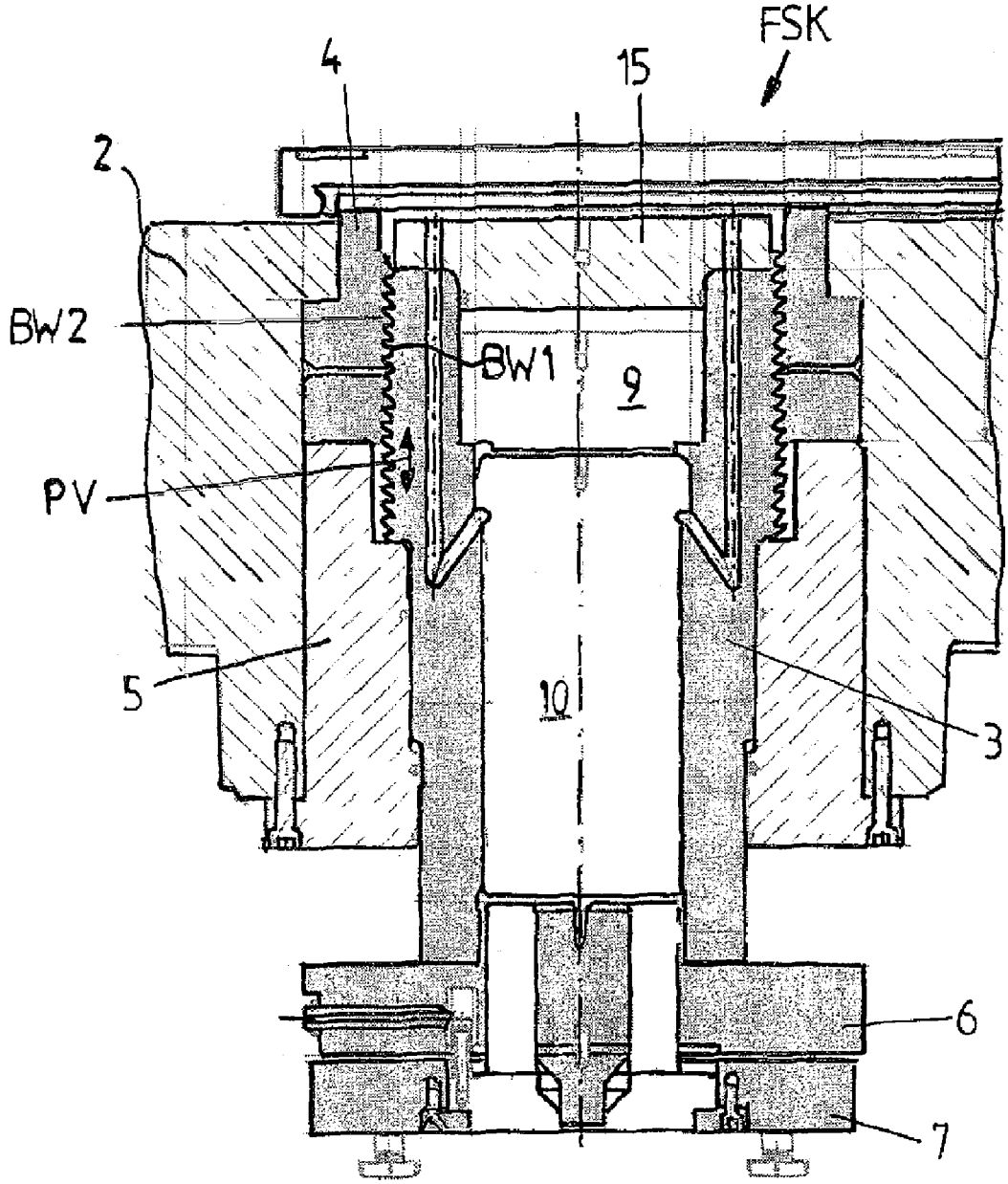
FIG. 2 is a cross-section of the device according to the invention in the extended state, FIG. 3. is a cross-section of the device according to the invention in the retracted state.

FIG. 2 shows the device according to the invention in cross-section. The device is assembled into the head piece 2 of the press and form-fit in place there. The device comprises a fine blanking head FSK, which includes a main cylinder 3, an adjusting nut 4, a flange 5 that is fixed to the head piece 2, a main plate 6 and a touch table 7. Main cylinder 3, adjusting nut 4, flange 5, main plate 6 and touch table 7 in combination provide a non-positive arrangement that diverts the whole pressure force into the head piece 2 of the press. The non-positive connection is achieved by locking the motion threads BW1 and BW2 at the head of the main cylinder 3 and at the adjusting nut 4 by pressing the motion thread BW1 of the main cylinder 3 against the motion thread BW2 of the adjusting nut 4 in the direction of the upper dead point OT with hydraulic pressure PV. Conversely, the locked two motion threads BW1 and BW2 are unlocked by switching off the hydraulic pressure PV.

The non-positive connection is illustrated by the gray colored area in FIG. 2.

The head piece 2 is connected to the frame 8 of the press by straining screws SB (see FIG. 1).

Main cylinder 3 retains within its hollow interior a V-shaped projection piston 9 and a touch piston 10 in axial alignment to each other. The V-shaped projection pins 11 penetrate the main plate 6 and are supported by V-shaped projection pressure plate 12, which is secured by a V-shaped projection retaining ring 13 fixed to the touch table 7.

The main cylinder 3 is sealed pressure-tight at its head side by a V-shaped projection cover 15. Above the V-shaped projection piston 9 a pressure room 16 is formed, which pressure room 16 is connected to a pressure pipe 56 through a connection 17 that is connected to pressure pipe 56 that is provided with an adjustable valve 18. With this arrangement, the pressure room 16 is connected to the hydraulic system that supplies the pressure for producing a hydraulic preloading pressure P1 that acts on the V-shaped projection piston 9 in the direction of the lower dead point UT.

Figure 3:
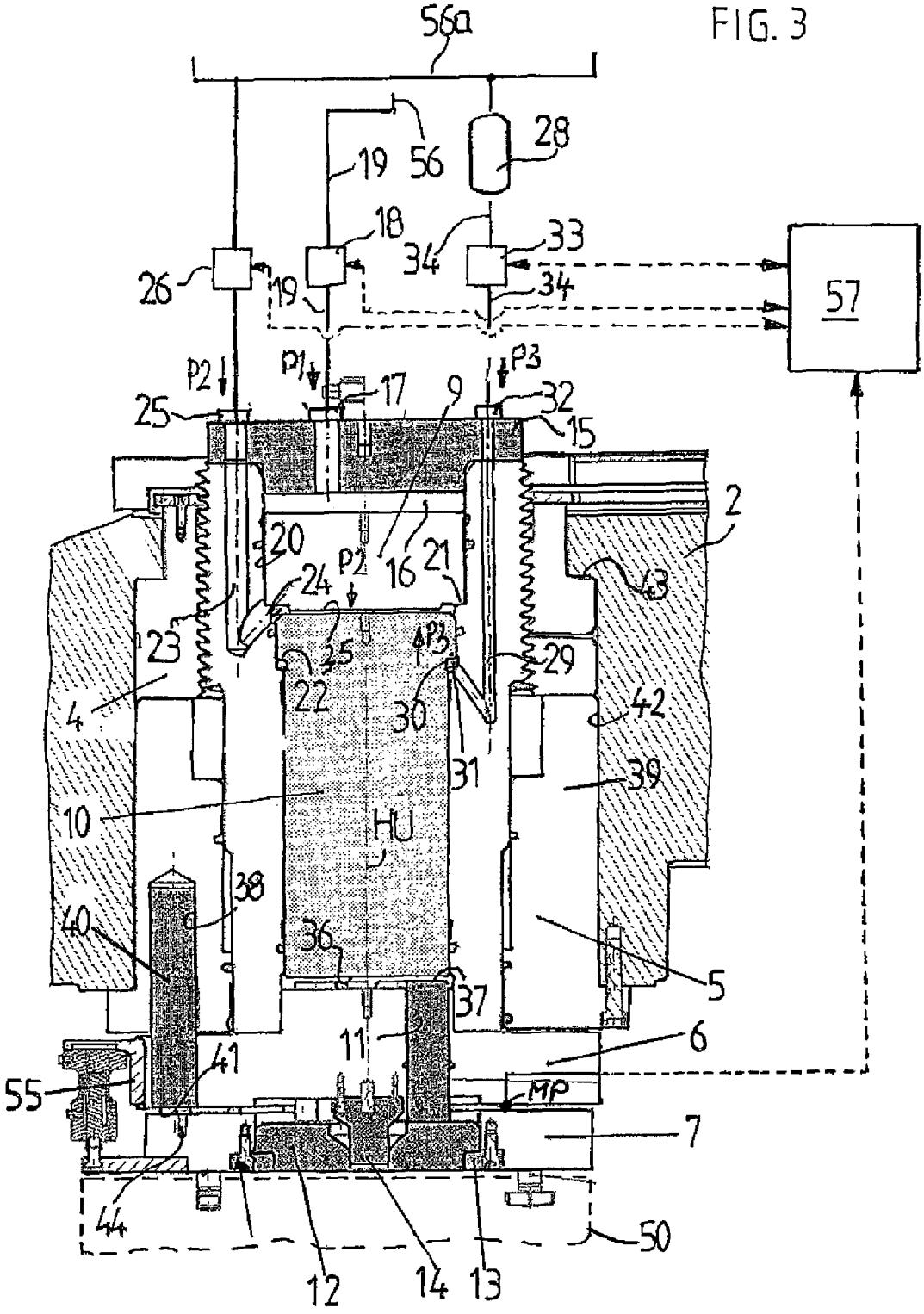

As shown in FIG. 3, the main cylinder 3 is provided at is internal wall 20 with a first step-like shoulder 21 projecting in the direction of the stroke axis HU. The shoulder supports and limits the stroke of the V-shaped projection piston 9 in the direction of the lower dead point UT. Below first shoulder 21, on the touch piston 10, is positioned a second shoulder 22 projecting in the direction of the stroke axis HU, that borders the pressure room 31 of the touch piston 10. An axially extending conduit 23 is provided in the wall 20 of the main cylinder 3, which has about a 45° bend in the direction of the stroke axis HU at a location below the first shoulder 21. The conduit 23 opens through the internal wall 20. A pressure room 24 is formed below the V-shaped projection piston 9, into which is fed the hydraulic fluid under touch piston pressure P2. The conduit 23 is in fluid connection to a low pressure pipe of the hydraulic system 56*a* through a feeding pipe 27 that is connected to connection 25 provided in V-shaped projection cover 15. The feeding pipe 27 is provided with a control valve 26.

Furthermore, the wall 20 of the main cylinder 3 is provided an axially extending conduit 29, which conduit has about a 45° bend in the direction of the stroke axis HU. The conduit 29 opens from the internal wall 20 below the second shoulder 22 provided on the touch piston 10 and provides a pressure room 31 below a shoulder 30 of the touch piston 10. The conduit 29 is in fluid connection with the hydraulic system 56*a* through feeding pipe 34 having reservoir 28 and control valve 33. This arrangement connects with conduit 29 through connection 32 provided in the V-shaped projection cover 15. Hydraulic fluid is admitted to the pressure room 31 in the direction of the upper dead point OT under a differential pressure P3, so that the touch piston 10 can be moved in the direction of the upper dead point OT.

The pressures P2 and P3 act against the preloading pressure P1, wherein the pressure P3 causes the touch piston 10 to non-positively connect to the lower side 35 of the V-shaped projection piston 9.

Between the lower side 36 of the touch piston 10 and the frontal surface 37 of the V-shaped projection pins 11 is provided a gap having a predetermined gap distance SP of, for example, 4 to 10 mm, preferably 6 mm.

The gap distance SP provides a stopping distance of sufficient length that is employed where an immediate stop of the press to brake the kinetic energy or to retard same is needed.

The V-shaped projection pins 11 are supported on the V-shaped projection pressure plate 12, so that a hydraulic displacement can be realized in dependence on the touch stroke, and the pressure P3 applied counter to the pressure P1. The total V-shaped projection force produced by the preloading pressure is thus reduced by the force produced by the differential pressure P3.

The head piece 2 at internal wall 42 that faces the stroke axis HU has step-like upper shoulder 43 that projects in the direction of the stroke axis HU, which upper shoulder 43 is supported by the adjusting nut 4, an arrangement that provides axial stability against upward movement of the adjusting nut 4, in the direction to the upper dead point OT. Also, the adjusting nut 4 is axially held in relation to the lower dead point UT by the tube-like part 39 of the flange 5.

In tube-like part of the flange 5, two holes 38 positioned diametrically opposite each other are provided, which are positioned in the tube-like part 39 parallel to the stroke axis HU. Holes 38 accommodate pin-like guiding pins 40 that axially guide the main plate 6 and provide antitwist protection for the main plate 6 and the main cylinder 3.

Figure 4:
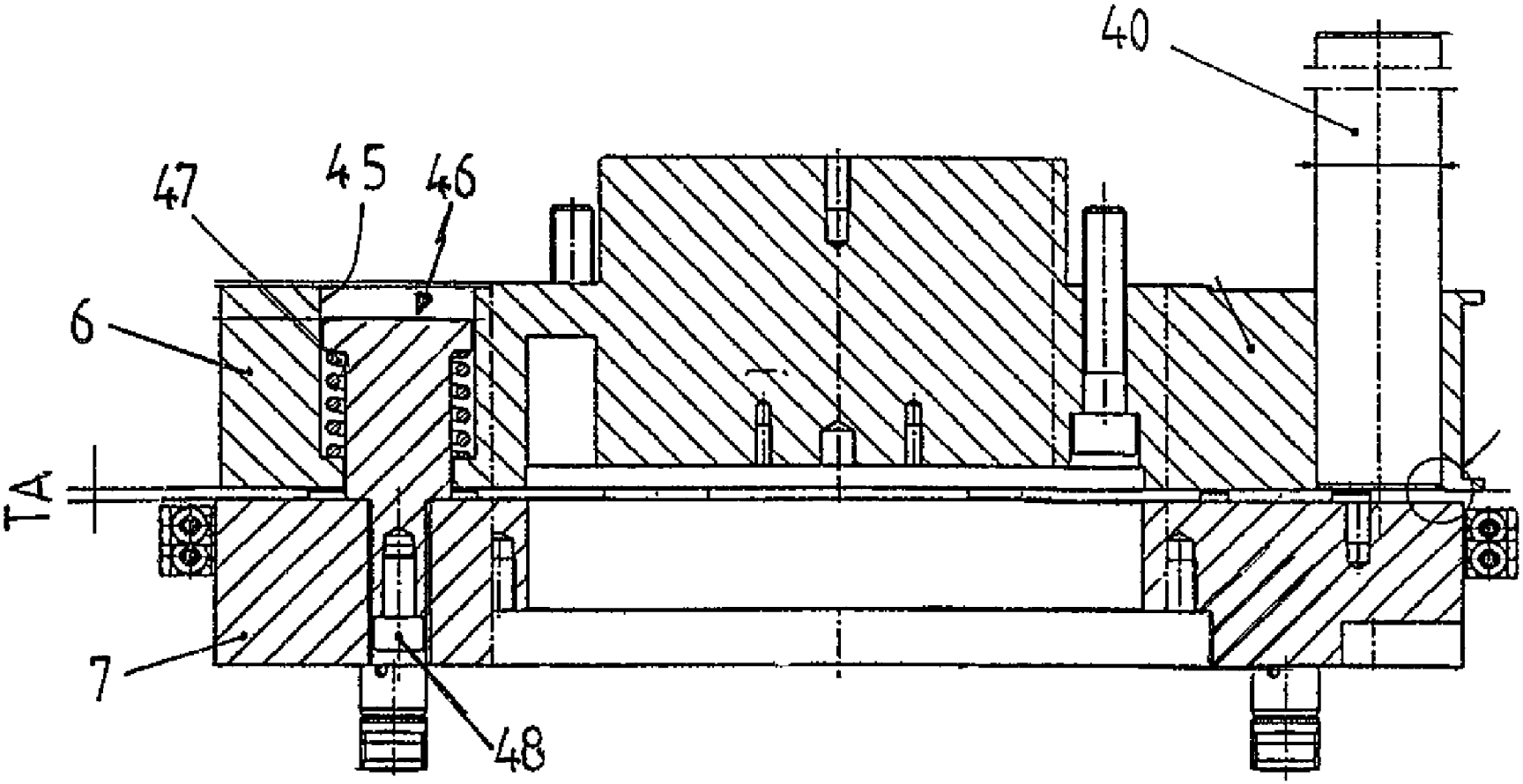
FIG. 4 is a cross-section of the main plate and the touch table with illustration of the mechanical weight compensation and FIG. 5 is a cut out cross-section of the main plate and the touch table illustrating the arrangement of the sensor and the position of gap distance and detection distance.

As shown in FIG. 4, in the main plate 6 a recess 45 is provided for accommodating a fixing means 46 including a pressure spring 47 and an adjusting screw 48.

The fixing means 46 makes it possible to compensate for the weight of the touch table 7 and the upper part of the tool 50 according to weight. In other words, the weights of the touch table 7 and the upper part of the tool 50 are compensated. At the lower side 49 of the touch table 7 are located standard fixing means for fixing the upper tool part 50, so that it is not necessary to describe them in detail.

Figure 5:
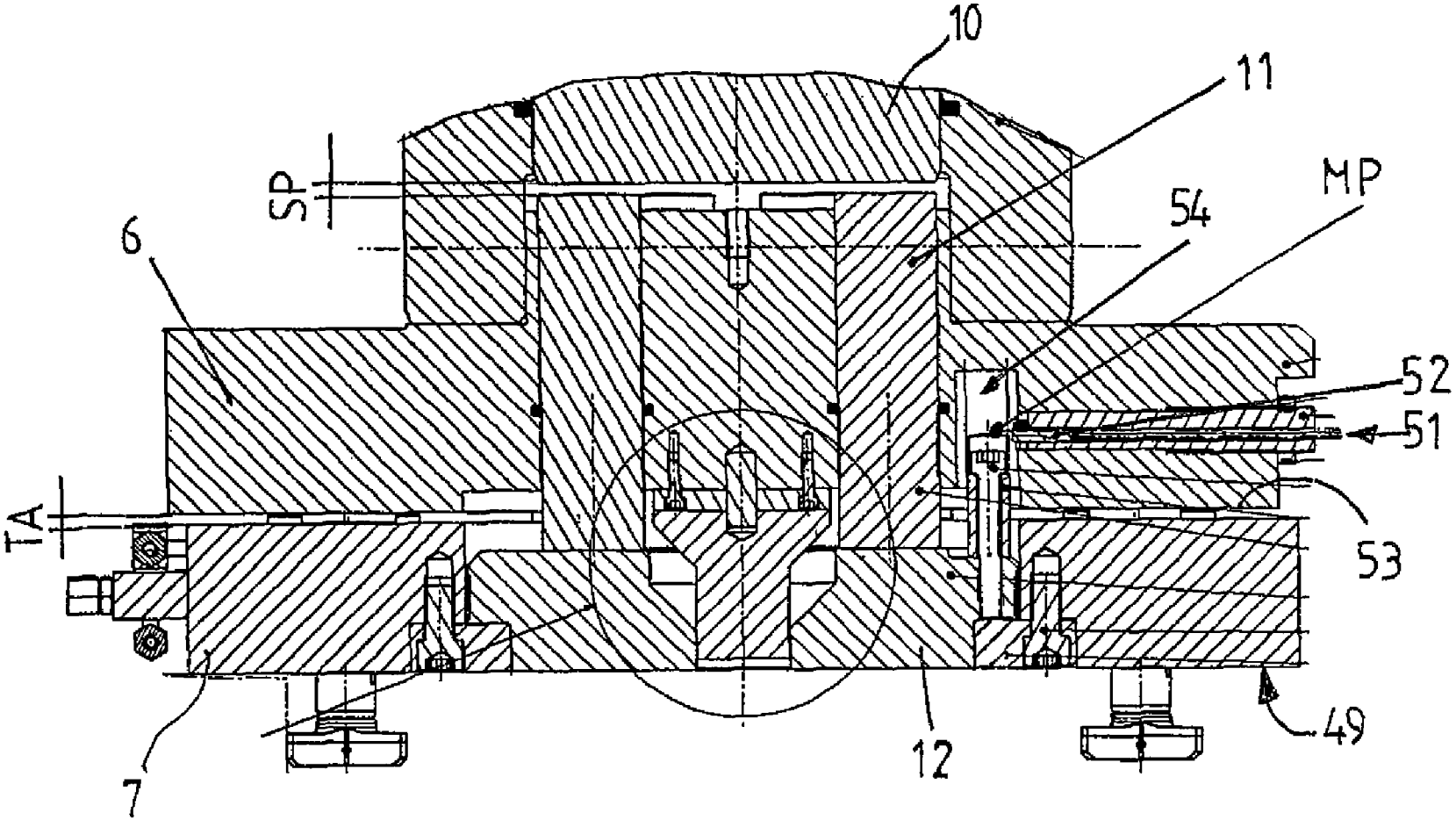

FIG. 5 shows in cross-section the main plate 6 and the touch table 7. Vertical to the stroke axis HU, the main plate 6 is provided with a recess 51, in which is positioned a sensor 52 for detecting the detection distance TA. The measuring point MP of the sensor 52 ends in a recess 54 arranged parallel to the stroke axis HU which is accessible from the lower side 53 of the main plate 6 for the measuring point MP of the sensor 52. In this manner, the sensor 52 determines the distance to be detected TA, and permits for adjustment of same.

FIG. 5 also illustrates the position of the gap distance SP between the lower side of the touch piston 10 and the frontal surface of the V-shaped projection pins 11, and the detection distance between the lower side 53 of the main plate 6 and the upper side of the touch table 7. As shown in FIG. 3, the hydraulic system includes a pressure pipe 56, which by a not shown pressure source is loaded to a pressure of 250 bar. To this pressure pipe 56 is connected feeding pipe 19 that extends through controllable proportional valve 18 to the pressure room 16 positioned above the V-shaped projection piston 9. Through proportional valve 18, the hydraulic preloading pressure P1 is fed, acting in the direction of the lower dead point UT on the V-shaped projection piston 9, to produce the V-shaped projection force. The preloading pressure P1 can be adjusted to a pressure between 20 and 250 bar.

From a low-pressure pipe 56*a*, a feeding pipe 27 via the controllable directional control valve 26 extends into the pressure room 24, to provide stripping pressure P4 for the touch piston 10. The touch piston pressure P2 is directly provided from the hydraulic system. A further feeding pipe 34 extends from the low-pressure pipe 56*a* via a reservoir 28 into the pressure room 31 below the touch piston 10. The differential pressure P3 acts against the preloading pressure P1 and makes it possible to not-positively connect touch piston 10 and V-shaped projection piston 9, in order to hold them connected. Also, it is possible to disconnect the non-positive connection between touch piston 10 and V-shaped projection piston 9 by again by switching on the valve 33. In this way, the pressure potential of the reservoir 28 can be emptied.

The operation of the device according to the invention is described in detail below. The preloading pressure P1 provides a projection force for the V-shaped piston 9, which projection force is diverted by the non-positive and/or positive connection of touch piston 10, V-shaped projection piston 9 and V-shaped projection pins 11. Before the preloading pressure P1 is admitted and until the non-positive connection of V-shaped projection piston 9 and touch piston 10 is reached, the V-shaped projection piston 9 and touch piston 10 are moving in alignment with the stroke axis HU, due to application of the applied differential pressure P3. This results in a non-positive connection between the lower side of the touch piston 10 and the frontal surface of the V-shaped projection piston 9. As shown in FIG. 5, a fixed gap is present between the touch piston 10 and the V-shaped projection pins 11, having a fix gap distance SP, which, for example, may be 6 mm.

The touch table 7 is suspendedly positioned at the main plate 6, with compensation for weight, wherein for axial movement of touch table 7 are provided four guiding pins 40, and for the weight compensation of same, four mechanical fixing means 46 in mechanical cooperation with high pressure spring 47 are provided, as aforedescribed.

A sensor 52, provided to detect a distance TA between the main plate 6 and touch table 7, can detect a too soon change of the detection distance TA that changes based on the ram stroke. The sensor 52 produces a signal sent to a computer 57 for processing the sensor signals.

In processing the signal, a differentiation occurs between two signal conditions. In a proper form-fit connection between V-shaped projection pressure plate 12, V-shaped projection pin 11, touch piston 10 and V-shaped projection piston 9, a displacement against the preloading pressure P1 is caused, that is carried out as a standard cancellation of the detection stroke. That is, the touch table 7 and the V-shaped projection pressure plate 12 touch the main plate 6 without detected change of the detection distance TA. The single process steps of the method according to the invention are carried out continuously.

However, where the detection distance TA is changed, for example, by the presence of punchings or other foreign bodies, the sensor 52 detects the change in detection distance and transmits this information to the computer 57, where it is processed further. The change of the detection distance caused by the presence of punchings or other foreign bodies leads to a too early cancellation of the detection stroke, so that the computer 57 causes an immediate stop of the press. The kinetic energy during, an immediate stop due to the sufficient high detection distance can be halted by the action of a brake, or retarded by action of the drive.

A method employing the advantages offered by the aforedescribed apparatus is described as follows. In process step (a), the V-shaped projection piston 9 and the touch piston 10 are preloaded to a high pressure P1.

In process step (b), the detection distance TA is adjusted to the gap distance SP of touch piston 10 and V-shaped projection pins 11 through application of the resulting differential pressure P3, whereby a non-positive connection between touch piston 10 and V-shaped projection piston 9 is realized. The differential pressure P3 is adjusted to 65 bar, for example.

In process step (c) it is provided that touch piston 10, V-shaped projection pins 11, V-shaped projection pressure plate 12, which are under the influence of differential pressure P3, and V-shaped projection piston 9, being under the influence of preloading pressure P1, are displaced by the ram 1.

In process step (d), the preloading pressure P1 is relieved when the V-shaped projection piston 9 is at the upper dead point OT, by turning off the preloading pressure source.

In process step (e), a differential pressure P3 of, for example 65 bar, is applied the touch piston 10, which makes it possible to realize or cancel the non-positive connection between touch piston 10 and V-shaped projection piston 9, due to axial movement of the touch piston 10.

In process step (f), the V-shaped projection piston 9 and the touch piston 10 are stripped at a desired stripping pressure P4 of, for example, 70 bar, which is adjusted with the valve 18 for adjusting pressure in the V-shaped projection piston 9 pressure room 16, with the differential pressure P3 being applied. Simultaneously with the stripping pressure P4 is applied the touch piston pressure P2, of for example 65 bar.

In process step (g), the stripping pressure P4 is switched off and the pressure P1 is applied to the upper pressure room 16 of the V-shaped projection piston 9, when via touch piston 10, V-shaped projection pins 11 and V-shaped projection pressure plate 12 was transmitted the signal for reaching the gap distance SP from the sensor 52.

The sequence of process steps (a) to (g) then is repeated.

When this closing movement is actuated by a too early change of the detection distance TA, a quick stop of the machine is carried out, so the press is immediately stopped, A too early closing movement is always then actuated, when punchings, parts or other foreign parts are in the upper tool, because this leads to a too early change of the detection distance TA.

The invention is claimed:

1. A device for preventing a tool from breaking during fine blanking and/or forming operations in a press, the tool comprising an upper and lower part, the device being positioned above a ram provided in the press, the ram carrying out a stroke movement along a stroke axis, the device positioned above the ram, the upper part of the tool connected to the device at a touch table provided on a ram side of the device, the device comprising:

a fine blanking head, the fine blanking head including a head piece frame holding a main cylinder, the main cylinder retaining a V-shaped projection piston aligned on the stroke axis, V-shaped projection pins that are coaxially arranged, with respect to the stroke axis, the V-shaped projection pins being axially guided by a main plate covering the main cylinder on a ram side thereof, the V-shaped projection pins being supported on a V-shaped projection pressure plate, wherein the main cylinder is provided with a pressure-tight seal at a top side of the main cylinder by a V-shaped projection cover;

a hydraulic system for generating pressure in the main cylinder, the hydraulic system being in connection with the fine blanking head and a source of pressurized fluid, the hydraulic system provided with valves under the control and operation of a computer, whereby the computer, through valve operation, controls and regulates the flow of pressurized fluid;

the main cylinder further retaining a touch piston positioned between the V-shaped projection piston and V-shaped projection pins, the V-shaped projection piston, the V-shaped projection pins, and the V-shaped projection pressure plate being in an axially movable arrangement with respect to each other in alignment along the stroke axis;

first, second, and third pressure rooms provided in the main cylinder, each respectively having a connection to the hydraulic system through, respectively, first, second, and third connections provided in the V-shaped projection cover;

the first pressure room allocated to a space in the main cylinder on an upper side of the V-shaped projection piston, whereby, upon admission of a pressure from the hydraulic system to the first pressure room, the first pressure room is pressurized with a preloading pressure;

the second pressure room allocated to a space in the main cylinder between the V-shaped projection piston and the touch piston, whereby, upon admission of a pressure from the hydraulic system to the second pressure room, the second pressure room is pressurized with a touch piston pressure; and the third pressure room allocated to a space in the main cylinder associated with the touch piston, whereby, upon admission of a pressure from the hydraulic system to the third pressure room, the third pressure room is pressurized with a differential pressure;

the second and third pressure rooms each being in connection with the hydraulic system though second and third pressure room conduits, respectively, whereby, when the first pressure room and at least one of the second and third pressure rooms are pressurized to effective pressure levels, the V-shaped projection piston and the touch piston are influenced by pressure in a direction opposite to the direction of the influence of the preloading pressure applied in the first pressure room to the V-shaped projection piston;

a touch table fixedly attached in suspension to the main plate by fixing means, the fixing means providing a gap having a predetermined gap dimension between the main plate and touch table, the predetermined gap dimension being detected by a sensor, the touch table being provided with means for attaching the upper part of the tool; and whereby, during operation of the press, in the event of a change in the predetermined gap dimension, the sensor transmits a signal to the computer, and in processing the signal, the computer stops the operation of the press to protect the upper part of the tool against damage.

2. The device according to claim 1, wherein the second pressure room is located below a shoulder provided on an interior wall of the main cylinder, the shoulder projecting in the direction of the stroke axis, the second pressure room being defined, in part, by a lower surface of the V-shaped projection piston.

3. The device according to claim 1, wherein the third pressure room is located below a shoulder of the touch piston that is positioned above a second shoulder provided on an interior wall of the main cylinder, the second shoulder projecting in the direction of the stroke axis.

4. The device according to claim 1, wherein the first pressure room is connected to a high pressure source in connection with the hydraulic system through a high pressure feed line provided with a proportional valve, the high pressure feed line being in connection with the first connection provided in the V-shaped projection cover, whereby the preloading pressure generated in the first pressure room produces a V-shaped projection force.

5. The device according to claim 1, wherein the second pressure room is connected to a low pressure source in connection with the hydraulic system through a second pressure room low pressure feed line provided with a directional control valve, the second pressure room low pressure feed line being in connection with the second connection provided in the V-shaped projection cover, whereby, upon admission of pressure from the low pressure source, the second pressure room is pressurized with a touch piston pressure.

6. The device according to claim 1, wherein the third pressure room is connected to a low pressure source in connection with the hydraulic system through a third pressure room low pressure feed line provided with a directional control valve, the third pressure room low pressure feed line being in connection with the third connection provided in the V-shaped projection cover, whereby, upon admission of pressure from the low pressure source, the third pressure room is pressurized with a differential pressure.

7. The device according to claim 1, wherein the second and third conduits each extend within a wall of the main cylinder, coaxial to the stroke axis for a length portion, and each further being provided with a bend at the ends of their respective length portions, each bend opening into the respective second and third pressure rooms, whereby the second and third conduits deliver, respectively, a touch pressure and a differential pressure to the V-shaped projection piston and the touch piston in a direction of force that opposes a direction of force of the preloading pressure applied to the V-shaped projection piston in the first pressure room.

8. The device according to claim 1, wherein the second conduit has a greater diameter than the third conduit.

9. The device according to claim 1, wherein the fixing means includes a pressure spring positioned around an adjustment screw, the fixing means being housed in an open ended recess that is provided in the main plate, the pressure spring bearing against a surface of the recess and a surface of the adjustment screw to provide a spring bias, the adjustment screw having an attachment portion extending through the open end of the recess, the attachment portion being attached to the touch table;

whereby the spring bias provided to the fixing means provides an adjustable weight compensation to the touch table and the upper part of the tool attached thereto.

10. The device according to claim 1, wherein the sensor is positioned in a seat provided in the main plate, whereby the sensor provides an adjustable measuring point of the gap dimension.

11. The device according to claim 1, wherein the main plate is attached to the ram side of the main cylinder by screws.

12. The device according to claim 1, wherein the main plate and a flange fixed to the head piece are provided with axially aligned holes that are coaxial to the stroke axis, the axially aligned holes in the main plate and flange receiving guide pins, whereby the main plate is rendered torsion-proof.

13. The device according to claim 1, wherein the main plate is provided with a central support in alignment with the stroke axis, and the V-shaped projection pressure plate is retained by a retaining ring housed in the touch table.

14. A method for preventing a tool with an upper and lower part from breaking during fine blanking and/or forming operations in a press employing a device positioned above a ram provided in the press, the ram carrying out a stroke movement along a stroke axis, the upper part of the tool connected to the device at a touch table provided an a ram side of the device, the device comprising:

a fine blanking head, the fine blanking head including a head piece frame holding a main cylinder, the main cylinder retaining a V-shaped projection piston aligned on the stroke axis, V-shaped projection pins that are coaxially arranged, with respect to the stroke axis, the V-shaped projection pins being axially guided by a main plate covering the main cylinder on a ram side thereof, the V-shaped projection pins being supported on a V-shaped projection pressure plate, wherein the main cylinder is provided with a pressure-tight seal at a top side of the main cylinder by a V-shaped projection cover;

a hydraulic system for generating pressure in the main cylinder, the hydraulic system being in connection with the fine blanking head and a source of pressurized fluid, the hydraulic system provided with valves under the control and operation of a computer, whereby the computer, through valve operation, controls and regulates the flow of pressurized fluid;

the main cylinder further retaining a touch piston positioned between the V-shaped projection piston and V-shaped projection pins, the V-shaped projection piston, the V-shaped projection pins, and the V-shaped projection pressure plate being in an axially movable arrangement with respect to each other in alignment along the stroke axis;

first, second, and third pressure rooms provided in the main cylinder, each respectively having a connection to the hydraulic system through, respectively, first, second, and third connections provided in the V-shaped projection cover;

the first pressure room allocated to a space in the main cylinder on an upper side of the V-shaped projection piston, whereby, upon admission of a pressure from the hydraulic system to the first pressure room, the first pressure room is pressurized with a preloading pressure;

the second pressure room allocated to a space in the main cylinder between the V-shaped projection piston and the touch piston, whereby, upon admission of a pressure from the hydraulic system to the second pressure room, the second pressure room is pressurized with a touch piston pressure; and the third pressure room allocated to a space in the main cylinder associated with the touch piston, whereby, upon admission of a pressure from the hydraulic system to the third pressure room, the third pressure room is pressurized with a differential pressure;

the second and third pressure rooms each being in connection with the hydraulic system though second and third pressure room conduits, respectively, whereby, when the first pressure room and at least one of the second and third pressure rooms are pressurized to effective pressure levels, the V-shaped projection piston and the touch piston are influenced by pressure in a direction opposite to the direction of the influence of the preloading pressure applied in the first pressure room to the V-shaped projection piston;

a touch table fixedly attached in suspension to the main plate by fixing means, the fixing means providing a gap having a predetermined gap dimension between the main plate and touch table, the predetermined gap dimension being detected by a sensor, the touch table being provided with means for attaching the upper part of the tool; and whereby, during operation of the press, in the event of a change in the predetermined gap dimension, the sensor transmits a signal to the computer, and in processing the signal, the computer stops the operation of the press to protect the upper part of the tool against damage, the method comprising the steps of:

diverting a pressure force through a non-positive connection and/or positive connection through hydraulic locking and unlocking of the touch table, the main plate, a central support, the main cylinder and an adjusting nut that are provided in the head piece;

axially shifting the V-shaped projection piston and the touch piston in alignment with the stroke axis prior to delivering the pressure force, until a time when the non-positive and/or positive connection between the V-shaped projection pressure plate, the V-shaped projection pins, the touch piston and V-shaped projection piston is attained;

adjusting a gap distance between the touch piston and V-shaped projection pins to a predetermined gap distance value through hydraulic means;

adjusting a gap dimension between the main plate and the touch table by mechanical means to a predetermined value, whereby the predetermined value of the gap dimension between the main plate and the touch table is substantially the same as the gap distance between the touch piston and V-shaped projection pins;

transmitting a signal to the computer, in the event a change in the predetermined value of the gap dimension between the main plate and the touch table during press operation is detected by a sensor; and shutting off the press, in response to the transmitting of the signal to the computer.

15. A method for preventing a tool with an upper and a lower part from breaking during fine blanking and/or forming operations in a press employing a device positioned above a ram provided in the press, the ram carrying out a stroke movement along a stroke axis, the upper part of the tool connected to the device at a touch table provided an a ram side of the device, the device comprising:

a fine blanking head, the fine blanking head including a head piece frame holding a main cylinder, the main cylinder retaining a V-shaped projection piston aligned on the stroke axis, V-shaped projection pins that are coaxially arranged, with respect to the stroke axis, the V-shaped projection pins being axially guided by a main plate covering the main cylinder on a ram side thereof, the V-shaped projection pins being supported on a V-shaped projection pressure plate, wherein the main cylinder is provided with a pressure-tight seal at a top side of the main cylinder by a V-shaped projection cover;

a hydraulic system for generating pressure in the main cylinder, the hydraulic system being in connection with the fine blanking head and a source of pressurized fluid, the hydraulic system provided with valves under the control and operation of a computer, whereby the computer, through valve operation, controls and regulates the flow of pressurized fluid;

the main cylinder further retaining a touch piston positioned between the V-shaped projection piston and V-shaped projection pins, the V-shaped projection piston, the V-shaped projection pins, and the V-shaped projection pressure plate being in an axially movable arrangement with respect to each other in alignment along the stroke axis;

first, second, and third pressure rooms provided in the main cylinder, each respectively having a connection to the hydraulic system through, respectively, first, second, and third connections provided in the V-shaped projection cover;

the first pressure room allocated to a space in the main cylinder on an upper side of the V-shaped projection piston, whereby, upon admission of a pressure from the hydraulic system to the first pressure room, the first pressure room is pressurized with a preloading pressure;

the second pressure room allocated to a space in the main cylinder between the V-shaped projection piston and the touch piston, whereby, upon admission of a pressure from the hydraulic system to the second pressure room, the second pressure room is pressurized with a touch piston pressure; and the third pressure room allocated to a space in the main cylinder associated with the touch piston, whereby, upon admission of a pressure from the hydraulic system to the third pressure room, the third pressure room is pressurized with a differential pressure;

the second and third pressure rooms each being in connection with the hydraulic system though second and third pressure room conduits, respectively, whereby, when the first pressure room and at least one of the second and third pressure rooms are pressurized to effective pressure levels, the V-shaped projection piston and the touch piston are influenced by pressure in a direction opposite to the direction of the influence of the preloading pressure applied in the first pressure room to the V-shaped projection piston;

a touch table fixedly attached in suspension to the main plate by fixing means, the fixing means providing a gap having a predetermined gap a dimension between the main plate and touch table, the predetermined gap dimension being detected by a sensor the touch table being provided with means for attaching the upper part of the tool; and whereby, during operation of the press, in the event of a change in the predetermined gap dimension, the sensor transmits a signal to the computer, and in processing the signal, the computer stops the operation of the press to protect the upper part of the tool against damage, the method comprising the steps of:

(a) preloading the V-shaped projection piston and the touch piston to a preloading pressure (P1) to cause a non-positive connection between the V-shaped projection piston and the touch piston;

(b) applying a differential pressure (P3) to the touch piston to cause axial shifting of the touch piston, wherein the differential pressure (P3) differs from the preloading pressure (P1);

(c) maintaining a predetermined gap dimension between the main plate and the touch table that is adjusted to a gap distance between the touch piston and the V-shaped projection pins through the combination of the differential pressure (P3) applied to the touch piston and the preloading pressure (P1), which the preloading pressure (P1) and the differential pressure (P3) are applied in directions opposite each other, to cause a non-positive connection between the touch piston and the V-shaped projection piston, and wherein P1>P3;

(d) superseding the differential pressure (P3) in the third pressure room with application of the preloading pressure (P1) that is applied in the first pressure room positioned above the third pressure room, relative to the location of the ram;

(e) relieving the preloading pressure (P1) on the V-shaped projection piston by switching off the preloading pressure (P1) at a moment when the V-shaped projection piston and touch piston have reached an upper dead point, whereby, the V-shaped projection piston and the touch piston attain a motionless state;

(f) stripping the V-shaped projection piston and the touch piston by applying a stripping pressure (P4) and a touch piston pressure (P2) to the first and second pressure rooms, respectively, each of the stripping pressure (P4) and the touch piston pressure (P2) having a constant value;

(g) shifting the V-shaped projection piston and the touch piston until a sensor triggers a signal;

(h) turning off the stripping pressure (P4) and applying the preloading pressure (P1) to the first pressure room; and (i) repeating steps (a) to (h) in the event the sensor has not detected a premature change of the predetermined gap dimension, in dependence on the ram stroke along the stroke axis.

16. The method according to claim 15, wherein the preloading pressure (P1) is greater than 110 bar.

17. The method according to claim 15, wherein the touch piston pressure (P2) and the stripping pressure (P4) are each maintained at pressures below 110 bar and the differential pressure (P3) is maintained at a pressure in the range of 0 to 110 bar.

18. The method according to claim 15, wherein the touch piston pressure (P2) and the differential pressure (P3) can each selectively be turned on and turned off.

19. The device according to claim 1, wherein a stripping pressure is generated in the first pressure room at a predetermined time to strip the V-shaped projection piston and the touch piston.

20. The device according to claim 7, wherein the second conduit has a greater diameter than the third conduit.

* * * * *